United States Patent [19]

Mitter

[11] 4,442,771

[45] Apr. 17, 1984

[54] APPARATUS FOR APPLYING A FOAMED TREATING MEDIUM TO A WORKPIECE

[76] Inventor: Mathias Mitter, Falkenstrasse 57, D-4815 Schloss Holte, Fed. Rep. of Germany

[21] Appl. No.: 324,822

[22] Filed: Nov. 25, 1981

[30] Foreign Application Priority Data

Nov. 26, 1980 [DE] Fed. Rep. of Germany ..... 3044409

[51] Int. Cl.[3] ..... B41L 13/02

[52] U.S. Cl. ..... 101/122; 101/124; 101/364; 118/213

[58] Field of Search ..... 118/213, 406, 414; 101/364, 120, 122

[56] References Cited

U.S. PATENT DOCUMENTS

| | | | |
|---|---|---|---|
| 457,663 | 8/1891 | Oldfield | 101/364 |
| 945,266 | 1/1910 | Dick | 101/120 |
| 1,447,849 | 3/1923 | Hough | 101/364 |
| 1,509,888 | 9/1924 | Weldon | 101/364 |
| 1,896,034 | 1/1933 | Weed | 101/364 |
| 2,363,137 | 11/1944 | Metcalf | 101/120 |
| 2,447,868 | 8/1948 | Ortleb | 101/364 |
| 3,084,661 | 4/1963 | Roberts | 118/406 |
| 3,094,924 | 6/1963 | Stark | 101/364 |
| 3,796,153 | 3/1974 | Jaffa | 101/120 |
| 4,103,614 | 8/1978 | Mitter | 101/116 |

FOREIGN PATENT DOCUMENTS

| | | | |
|---|---|---|---|
| 432091 | 7/1926 | Fed. Rep. of Germany | 118/414 |
| 1964908 | 8/1970 | Fed. Rep. of Germany | 118/414 |
| 2754663 | 6/1979 | Fed. Rep. of Germany | 101/120 |
| 2951250 | 9/1980 | Fed. Rep. of Germany | 101/364 |
| 592517 | 5/1925 | France | 101/120 |

*Primary Examiner*—Clyde I. Coughenour
*Attorney, Agent, or Firm*—Peter K. Kontler

[57] ABSTRACT

Apparatus for applying a foamed treating medium to the upper side of a substrate has a screen which confines a system of walls defining a chamber open at its underside adjacent to the screen and including a squeegee which serves to force the foamed medium from the interior of the chamber through the interstices of the screen and into the substrate. The chamber accommodates a reciprocable and/or rotary device for shifting the foamed medium therein so that the medium cannot age and change its color and/or other characteristics prior to application to the substrate.

13 Claims, 4 Drawing Figures

3
30
1
21
2
20
51
50
5
70
4
60
6
7
S
71

APPARATUS FOR APPLYING A FOAMED TREATING MEDIUM TO A WORKPIECE

BACKGROUND OF THE INVENTION

The present invention relates to apparatus for the application of a foamed treating medium to a workpiece.

An apparatus of this general type is disclosed in German Printed Application OS No. 2,523,062. This Application discloses a method and an apparatus for the uniform application of liquid treating media to textile workpieces, and it further discloses that the treating media are foamed before application.

Applicant himself has already suggested in prior applications that such foamed treating medium be applied to the workpiece not directly, but rather through a printing screen or a screen-like intermediate carrier in order to ensure a more uniform distribution of the printing medium over the surface of the workpiece. The foamed printing medium is applied to the printing screen or screen-like carrier (as used herein, the word "screen" will designate any screen-like carrier) at atmospheric pressure and can be pressed and/or aspirated through the screen.

The application of foamed printing medium to such a screen presents problems in that the screen has opened and closed surface portions, depending upon which of its many holes are blocked in order to produce a printed pattern. Considering the width of the workpiece, this means that there are regions where there is a strong demand for treating medium (i.e. regions where the holes of the screen are unblocked) and others in which there is little or no demand for treating medium. To be taken into account in this context is the fact that the foam bubbles will burst on the upper surface of the screen, so that their liquid is released to form a film on the upper surface of the screen. Particularly in the treatment of textiles with such media, it is expected that the amount of treating liquid applied per unit surface area may deviate at most by 1 to 5% from the intended quantity. This is normally achieved by applying foamed treating medium to a workpiece through a screen, but the quality of the treated workpiece is adversely affected if there are areas of the screen on which the foam ages and for example its color changes. The aged foam will, when it bubbles finally burst, release less liquid than newly supplied foam. Therefore it is necessary to ensure that the foam is constantly being used up.

OBJECTS AND SUMMARY OF THE INVENTION

It is an object of the present invention to provide an improved apparatus for applying a foamed treating medium to a workpiece.

More particularly, it is an object of the present invention to provide an apparatus for applying a foamed treating medium to a workpiece through a screen in such a manner that the foam which is applied to the surface of the screen in constantly used up and is not allowed to age at any point of the screen surface.

One feature of the invention resides in the provision of an apparatus for applying a foamed treating medium to a workpiece, and such apparatus comprises a screen arranged above the upper side of the workpiece, means defining a circumferentially enclosed space above the screen and having a bottom side open to the screen, and means for admitting the foamed treating medium into this space.

Furthermore, the apparatus comprises squeegee means for forcing the foamed treating medium through the screen into contact with the workpiece, and moving means for moving the foamed treating medium about within the enclosed space.

An apparatus according to the present invention ensures that no foam on the screen can age because the constant turnover of the foam causes it to be supplied to the screen areas which allow larger quantities of treating medium to pass therethrough.

According to a further embodiment of the invention the moving means may be an element which is provided with compartmentizing or dividing walls and is acted upon by a displacing means in the form of a reciprocatory drive or a rotary drive so as to effect constant turnover of the foam.

The dividing walls may simply be straight sheet-metal walls which are mounted on a rod or the like. They may be inclined with reference to the longitudinal direction of the rod, particularly if the rod rotates, and this ensures that during their movement they sweep the entire or at least substantially the entire open bottom surface area of the enclosed space.

If a reciprocatory drive is used, it is preferably of the adjustable type so that the extent of reciprocation can be adjusted.

Furthermore, the speed of the reciprocatory respectively the rotary drive can be adjustable.

The divider walls may be in the form of spaced apart walls having lower edges adjacent to the screen and conforming to the configuration of the screen, and these walls may extend up to the squeegee. The squeegee is preferably but not necessarily a roller squeegee and the divider walls are preferably located upstream or ahead of the squeegee and have edges facing the squeegee and conforming to the contour of the squeegee.

It is important to realize that foam remains wherever it is applied and does not flow so that, without the constant turnover effected by the apparatus according to the present invention, the purposes of the invention could not be achieved.

The moving means should, of course, preferably extend over the entire width of the screen or of the workpiece beneath the same.

The invention will hereafter be described with reference to exemplary embodiments. However, it should be understood that the invention is not limited to the embodiments which are illustrated in the attached drawings and that various modifications and changes are possible.

DESCRIPTION OF THE PREFERRED EMBODIMENTS

Figure 1:
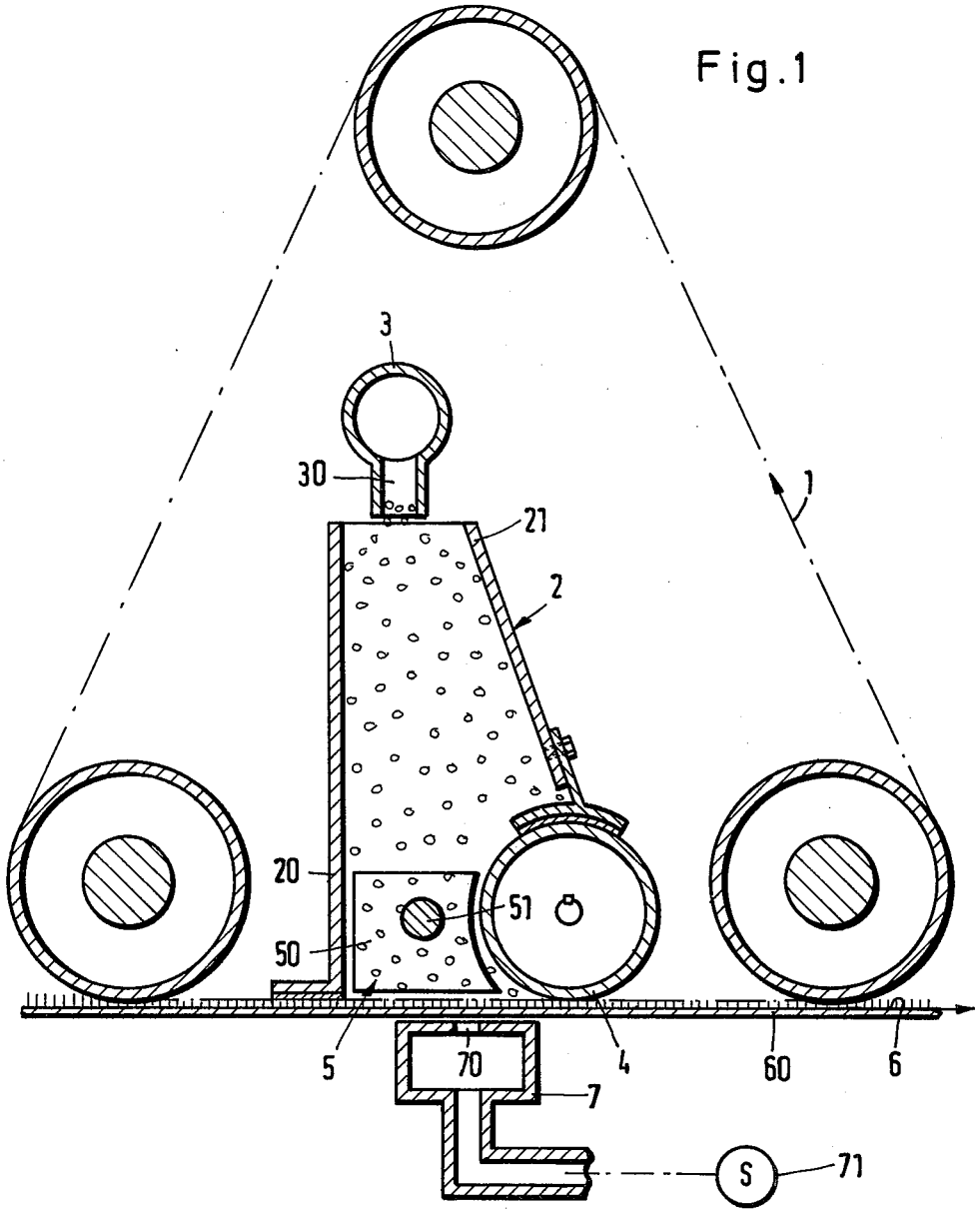
FIG. 1 is a elevational view of an apparatus according to the present invention.

Referring first to FIG. 1, the apparatus according to the present invention may constitute or resemble a screen printing machine. For the purposes of explanation, it will be so described herein. The apparatus of FIG. 1 has an endless printing screen 1 which is known per se and is trained about rollers one or more of which may be driven. This type of machine is known. However, the invention is not limited to screen printing machines nor is it limited to the type having an endless printing screen, although the problem to be solved is of particular importance in a screen printing machine having an endless printing screen as shown in FIG. 1.

Mounted within the confines of the printing screen is a container 2 above which there is a supply device 3 for the foamed treating medium, for example printing ink, and this device is preferably provided with a number of outlet openings 30.

The foamed treating medium is admitted into the container 2 at the downstream end of which—as considered in the direction of movement of a workpiece 6—there is provided an applicator 4, shown in the form of a roler squeegee. Arranged in the interior of the container 2 is a moving means or foam shifting means 5 whose purpose is to constantly turn over the foam which is supplied to the interior of the container 2.

In the embodiment of FIG. 1, the moving means 5 is composed of a plurality of divider walls 50 which are mounted at spaced intervals on a rod 51. These walls 50 may be simple sheet-metal blanks approximately bridging the space between one wall 20 of the container 2 (located at the upstream side of the container) and the squeegee 4 (at the downstream side of the container). It should be understood that any other kind of applicator means can be used in lieu of a roller squeegee, for example, a doctor blade or the like, and that the container 2 itself can be constructed as a slot-type squeegee so that its wall 21 would extend all the way to the printing screen 1 and have a squeegee edge (like a doctor blade) at its lower margin. The use of a roller squeegee, however, has the advantage that the foam is pressed more effectively through the screen 1 and into the underlying workpiece 6. The workpiece 6 itself is supported on a gas-permeable printing blanket 60.

A suction device 7, for example a suction box provided with a slot 70 and connected to a suction pump 71, may be mounted beneath the container 2 and the position of the suction device may be adjustable relative to the container 2.

What is important in the context of the invention is that the moving means 50 should fill or substantially fill the space between the wall 20 and the squeegee 4 or any other type of squeegee used in place of it. It is advantageous if the divider walls 50 do not contact the wall of the squeegee 4, for which purpose the edges facing the squeegee 4 may be so shaped as to conform to the contour of the squeegee but without touching the same.

Figure 2:
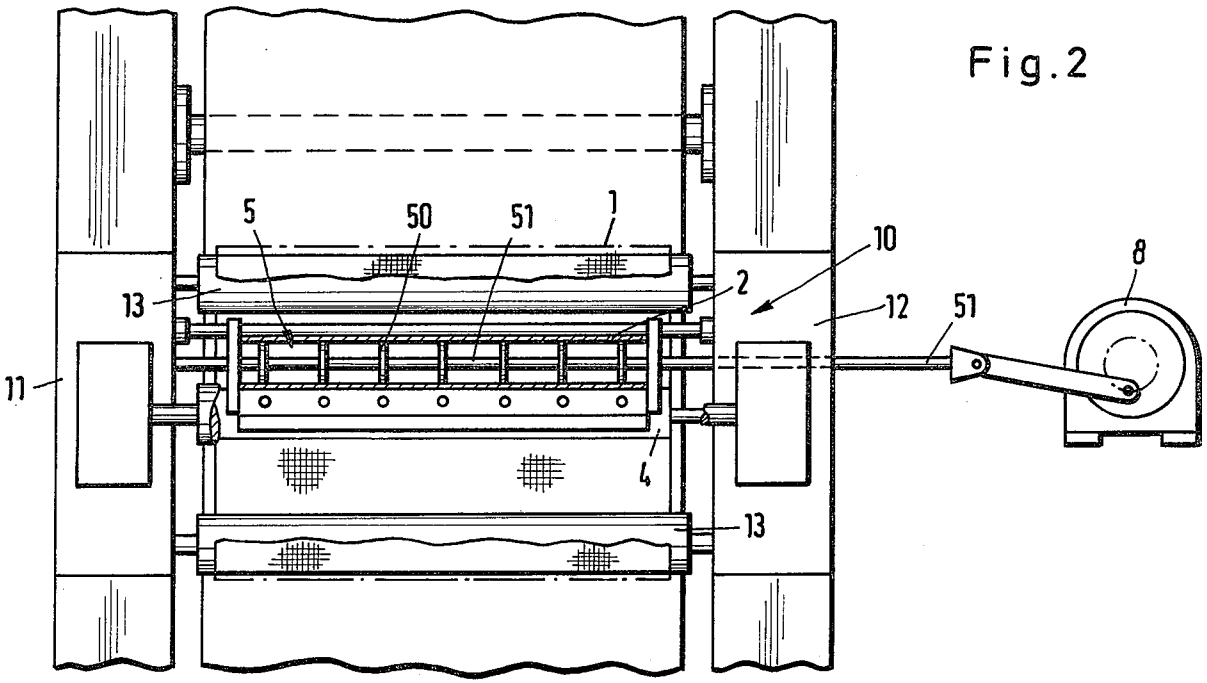
FIG. 2 is a plan view of a modification of the apparatus which is shown in FIG. 1.

The embodiment of FIG. 2 is a modification of the one in FIG. 1 and shows the container 2 in section. In this embodiment the printing station 10 is composed of lateral bearing heads 11 and 12 which carry in known manner a number of rollers 13 one or more which may be driven and about which the printing screen is trained. A printing station of this type is known per se.

In the interior of each such printing station is arranged a container 2 of the type described with reference to FIG. 1. in which a moving means 5 is accommodated. The divider walls 50 and rod 51 thereof are similar to those shown in FIG. 1. In FIG. 2, however, there is also illustrated a displacing means in the form of a reciprocatory drive 8 which includes a motor and a transmission with a crank or the like, depending upon the particular application. It is particularly desirable, however, that the stroke be adjustable and that the speed of reciprocation be variable. Furthermore, it is advantageous if the speed of advancement of the printing screen 1 can be regulated jointly with the speed of the reciprocatory drive; instrumentalities for this purpose are known to those skilled in the art.

Figure 3:
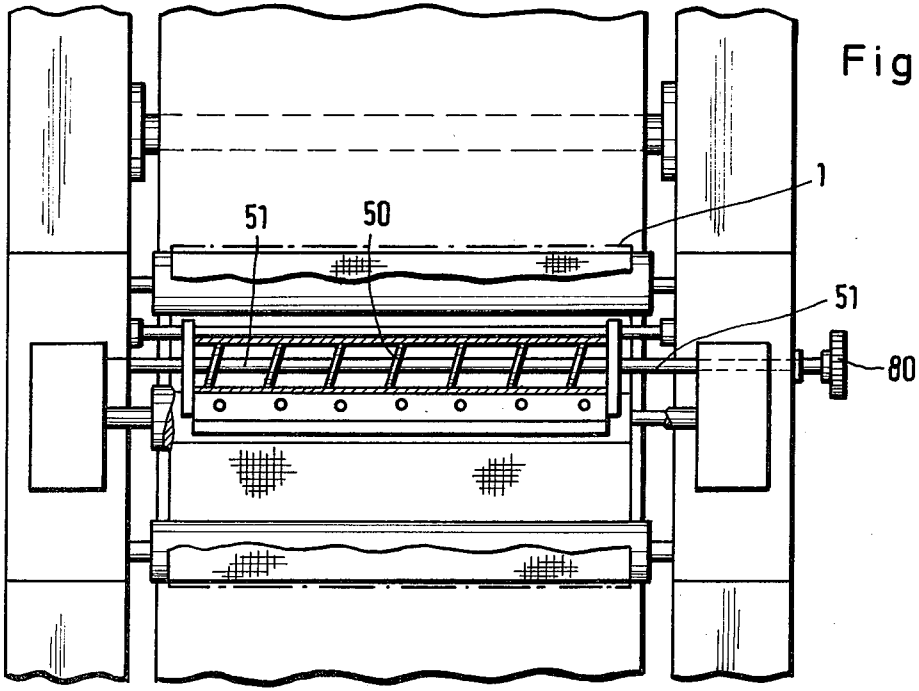
FIG. 3 is a view similiar to that of FIG. 2 but illustrating a further embodiment of the invention.

FIG. 3 illustrates an embodiment in which the divider walls 50 are inclined with reference to the longitudinal direction of their rod 51. The rod 51 is rotated by a rotary drive 80, known per se, and the walls 50 are preferably of circular configuration. When the rod 51 is rotated, the walls 50 move in such a manner that they move the foam to and fro across the width of the printing screen 1. In this embodiment, the divider walls do not have surface-to-surface contact with the printing screen, but have only linear contact therewith, due to their circular configuration.

Figure 4:
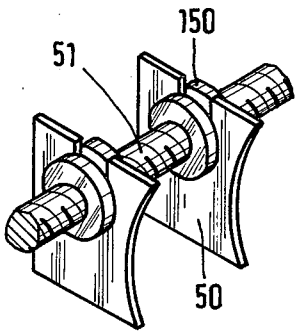
FIG. 4 is an enlarged perspective view, showing a detail in still another embodiment of the apparatus.

As shown in FIG. 4, it is also possible to removably mount the divider walls 50 on the rod 51 and to fix them in place by the use of suitable nuts or the like and in such a manner that their spacing from one another can be varied. The purpose of this would be to conform the moving means 5 to the foam-use requirements of a particular application. In this embodiment the divider walls 50 have U-shaped cutouts 150 for convenient displacement and also for the replacement or removal of individual walls, for example in the event of breakage or damage.

The moving means 5 need by no means be only of the type illustrated in the drawing. For example, it may be in form of a screw which may be provided with a reciprocatory rack and pinion drive so that it alternately turns to the right once and then to the left once to ensure that the screw threads do not always transport the foam to one side of the printing screen 1, but transport it back again.

It is also possible to replace the rod 51—which in these embodiments is located centrally of the walls 50—with mounting means located at the upper edges of the walls 50 so that these walls then extend downwardly from the mounting means in a comb-shaped fashion.

In all of the disclosed embodiments, the apparatus according to the present invention ensures that the foam in the enclosed space in the container 2 is constantly turned over, so that it cannot age at any point within the container. Incidentally, such agitation of the foam may cause the development of some foam bubbles so that some new foam may be created.

While the invention has been described with reference to specific embodiments illustrated in the drawing, it should be understood that various modifications and changes are possible and, accordingly, all such modifications and changes are intended to be encompassed within the range of equivalence of the appended claims.

The inventor's idea is not limited to a device with a printing screen 1 on the workpiece 6.

If the apparatus employs a printing screen 1, the moving means 5 for moving the foamed treating medium with reference to the screen is very important, but it is possible to install the moving means 5 in such a way that it directly acts on the workpiece 6 or at a small distance above the workpiece 6.

The applying device is the same as described hereinbefore the printing screen 1, however, does not exist, i.e. the moving means 5 acts on the workpiece 6, it is installed in the container 2, and it is located in front of the squeegee 4, resp. above the suction device and the workpiece 6.

I claim:

1. Apparatus for applying a foamed treating medium to the upper side of a foraminous workpiece, comprising a screen disposed above the upper side of the workpiece and having at least one first portion of greater permeability and at least one second portion of lesser permeability; confining means defining a circumferentially enclosed space above said screen and having an open bottom side adjacent to the screen; foam generator means; means for admitting the foamed treating medium from said foam generator means into said space; applicator means for forcing the foamed treating medium from said space through said screen and into contact with the workpiece whereby the rate of penetration of foamed treating medium by way of the first portion of said screen exceeds the rate of penetration by way of the second portion of said screen with attendant accumulation of foamed treating medium above said second portion; means for moving at least some of the accumulated foamed treating medium from above said second portion to above said first portion of the screen; means for displacing said moving means in said space with reference to said confining means at a speed such that the movements of said moving means do not entail mechanical destruction of the foamed treating medium in said space; and suction generating means disposed below the screen and the workpiece and arranged to draw the treating medium through the screen and into the workpiece.

2. Apparatus as defined in claim 1, wherein said moving means comprises an element having compartmentizing walls and said displacing means includes means for reciprocating the element transversely of the screen.

3. Apparatus as defined in claim 1, wherein said moving means comprises an element having compartmentizing walls and said displacing means includes means for rotating said element relative to the screen.

4. Apparatus as defined in claim 1, wherein said moving means comprises an element having compartmentizing walls which sweep over substantially the entire area of the open bottom side of said enclosed space.

5. Apparatus as defined in claim 1, wherein said moving means comprises an element having compartmentizing walls and means, said displacing means comprises a variable-stroke reciprocating drive.

6. Apparatus as defined in claim 1, wherein said moving means comprises an element having compartmentizing walls and said displacing means comprises a variable-speed reciprocating drive.

7. Apparatus as defined in claim 1, wherein said moving means comprises an element having compartmentizing walls and said displacing means comprises a variable-speed rotary drive.

8. Apparatus as defined in claim 1, wherein said moving means comprises an element having compartmentizing walls consisting of sheet metal and provided with edges adjacent to the screen, said walls extending to said applicator means.

9. Apparatus as defined in claim 1, wherein said applicator means comprises a roller squeegee.

10. Apparatus as defined in claim 1, wherein said moving means comprises compartmentizing walls arranged ahead of said applicator means and having edges facing the same and shaped to conform thereto.

11. Apparatus as defined in claim 1, wherein said moving means is a reciprocating feed screw.

12. Apparatus as defined in claim 1, wherein said moving means comprises compartmentizing walls extending between said applicator means and the respective boundaries of said enclosed space with sufficient clearance to permit movement of the walls within said space.

13. Apparatus as defined in claim 1, wherein said moving means comprises compartmentizing walls the mutual spacing between which is adjustable.

* * * * *